US007038705B2

(12) United States Patent
Miyachi et al.

(10) Patent No.: US 7,038,705 B2
(45) Date of Patent: May 2, 2006

(54) THERMAL HEAD

(75) Inventors: Yukiya Miyachi, Saitama (JP); Satoru Goto, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 69 days.

(21) Appl. No.: 10/849,163

(22) Filed: May 20, 2004

(65) Prior Publication Data

US 2004/0233268 A1 Nov. 25, 2004

(30) Foreign Application Priority Data

May 22, 2003 (JP) ..... 2003-145077

(51) Int. Cl.
*B41J 2/335* (2006.01)

(52) U.S. Cl. ..... 347/207

(58) Field of Classification Search ..... 347/202, 347/205, 207

See application file for complete search history.

(56) References Cited

U.S. PATENT DOCUMENTS 5,940,109 A * 8/1999 Taniguchi et al. ..... 347/205

FOREIGN PATENT DOCUMENTS

| | | | |
|---|---|---|---|
| JP | 9-058037 | * | 3/1997 |
| JP | 10-024615 A | | 1/1998 |
| JP | 3057813 B2 | | 4/2000 |

* cited by examiner

*Primary Examiner*—Huan Tran
(74) *Attorney, Agent, or Firm*—Sughrue Mion, PLLC

(57) ABSTRACT

A layer of thermal insulator is disposed on at least one of an electrically insulating substrate, an adhesive layer and a heat dissipating plate downstream to heating elements on the substrate in a supply direction of a color thermal recording sheet when executing thermal recording. In a manner that the thermal insulator is provided, when executing thermal recording on color thermal recording sheet, heat generated at heating elements is dissipated outside neither from the distal end of the insulating substrate downstream in a supply direction of the insulating substrate nor from the heat dissipating plate through adhesive layer. Since reduction in temperature is suppressed downstream in a supply direction, condensation of steam or vapor is prevented on the protective layer located at topmost of the thermal head, so that printing failure can be avoided.

12 Claims, 7 Drawing Sheets

THERMAL HEAD

BACKGROUND OF THE INVENTION

1. Field of the Invention

The present invention relates to a thermal head, and more particularly, relates to a thermal head for executing thermal recording on a thermal recording material.

2. Explanation of the Prior Art

In a color thermal printer, full color image is recorded on a color thermal recording sheet during transportation thereof by executing thermal recording thereon. The color thermal recording includes a cyan thermal coloring layer, a magenta thermal coloring layer, and a yellow thermal coloring layer, overlaid on a support in sequence on one another. In addition, a transparent protecting layer is provided on the yellow thermal coloring layer. Thermal recording of the image is executed on yellow, magenta and cyan thermal coloring layers in sequence. After executing thermal recording on the yellow and magenta thermal coloring layers, near ultraviolet rays of which the peak value is 420 nm, and ultraviolet rays of which the peak value is 365 nm, are respectively irradiated, to optically fix the yellow and magenta images. The protective layer protects the thermal coloring layers and imparts glossiness thereon, thereby increasing printing quality.

The thermal head includes a vitreous glaze for storing heat on which a heat-generating resistor, individual (discrete) and common electrodes are overlaid. The protective layer covers the surface of the thermal head. JP-A 10-24615 discloses a thermal head, in which a heat reserving layer is formed on a thermal dissipating substrate by evaporation and a thermal diffusion control layer is provided between an electrically insulating substrate and the heat reserving layer in order to prevent degradation of heat insulating ability of the insulating substrate. Moreover, JP-B No. 3057813 discloses a thermal head which includes a beltlike thermal insulating layer provided inside a glaze layer formed on the surface of the insulating substrate along a main scan direction, in order to utilize heat generated at the heat-generating resistor.

There is a printer in which a color thermal recording sheet is pressed during thermal recording by a thermal head of a partial glaze type provided with a cylindrical partial glaze layer on the insulating substrate. In the thermal head of the partial glaze type, heat generated at the heat-generating resistor is discharged through the distal end of the insulating substrate downstream in a sheet supply direction and through the thermal dissipating layer adhered to the insulating substrate. According to heat dissipation, temperature of downstream side of the protective layer in the sheet transporting direction becomes low compared to that near the heat-generating resistors.

When executing thermal recording on the recording sheet, particularly for a cyan image which has lowest heat sensitivity among three thermal coloring images, steam occurs on recording sheet due to increased temperature thereof. The steam or vapor condensates on the surface of the protecting layer downstream in a supply direction where temperature is low, so that water drops are generated. However, it is likely to occur printing failure such as recession on recording sheet, since water drop on the protecting layer is stacked to recording sheet.

In order to solve the above problems, a conventional thermal head includes a heater attached to lower portion of the thermal dissipating substrate or a heat sink. The thermal head is entirely heated by driving the heater during thermal recording, whereby temperature of the protecting layer downstream in a supply direction increases. This prevents condensation of vapor.

However, the thermal head with a heater is costly. Moreover, power consumption for the thermal head entirely increases because driving power for the heater is required. Furthermore, the thermal head is not cooled enough due to entire heating of the thermal head for the purpose of preventing condensation. Therefore, the thermal head is likely to be overheated, so it is difficult to implement continuous printing.

SUMMARY OF THE INVENTION

An object of the present invention is to provide a thermal head for protecting against condensation of steam or vapor on a protective layer downstream in a supply direction, without a heater on the thermal head, thereby to avoid printing failure. Condensation of steam or vapor occurs on the protective layer downstream in a supply direction since temperature thereof is lower than that of heating elements. Therefore, if reduction in temperature downstream to the heat emitting elements is suppressed, condensation of steam or vapor can be prevented. To attain the above objects, the thermal head of the present invention is provided with a thermally insulating material disposed downstream to the heating elements in a supply direction of a thermal recording material, for preventing heat generated at the heating elements from being dissipated outside the thermal head.

According to the preferred embodiment of the present invention, the thermal head is provided with a partial glaze layer and a heat-generating resistor layer which are overlaid on a substrate, and individual and common electrodes arranged on the heat-generating resistors layer along in a supply direction.

The region between the individual and common electrodes becomes the heating elements. The thermal insulator is disposed on the substrate in the opposite side of the partial glaze layer. It is preferable to cover the distal face of the substrate downstream in a supply direction with the thermal insulator.

According to the preferred embodiment of the present invention, a heat dissipating material is disposed on the substrate in the opposite side of the heating elements. In this case, the thermal insulator is disposed on the heat dissipating material. It is also preferable to cover the distal face of the substrate downstream in a supply direction with the thermal insulator. According to the preferred embodiment of the present invention, an adhesive layer is provided on the substrate in the opposite side of the heating elements, through which heat dissipating material is attached to the substrate. The adhesive layer is provided downstream to the heat emitting elements in a supply direction, including insulating adhesive layer consisting the thermally insulating material and a heat dissipating adhesive layer adjacent to the insulating adhesive layer.

Furthermore, a heat dissipating layer is overlaid on a back surface of the substrate and the thermal insulator located opposite to the heating elements. In another preferred embodiment, furthermore, a heat dissipating layer is disposed between the substrate and the thermal insulator. The thermal insulator is shaped with a thickness that increases downstream with reference to the supply direction.

In one preferred embodiment, the thermal insulator includes a horizontal section disposed on a back surface of the substrate located opposite to the heating elements. An erect section is disposed to project from a downstream end of the horizontal section, and positioned downstream from the substrate. Furthermore, a back hole is formed in the back surface of the substrate. The thermal insulator further includes a projecting portion disposed to project from the horizontal section, and received in the back hole.

The thermal insulator may be provided on at least one of the substrate, the heat dissipating material and the adhesive layer. A plurality of thermal insulators may be provided. According to the thermal head in the present invention, the thermal insulator is provided downstream to the heat emitting elements, to prevent heat generated at the heating elements from being dissipated outside the thermal head, so that reduction in temperature downstream to the heat emitting elements can be suppressed. Accordingly, it is possible to prevent condensation of steam or vapor on the thermal head with a simple structure at low cost.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
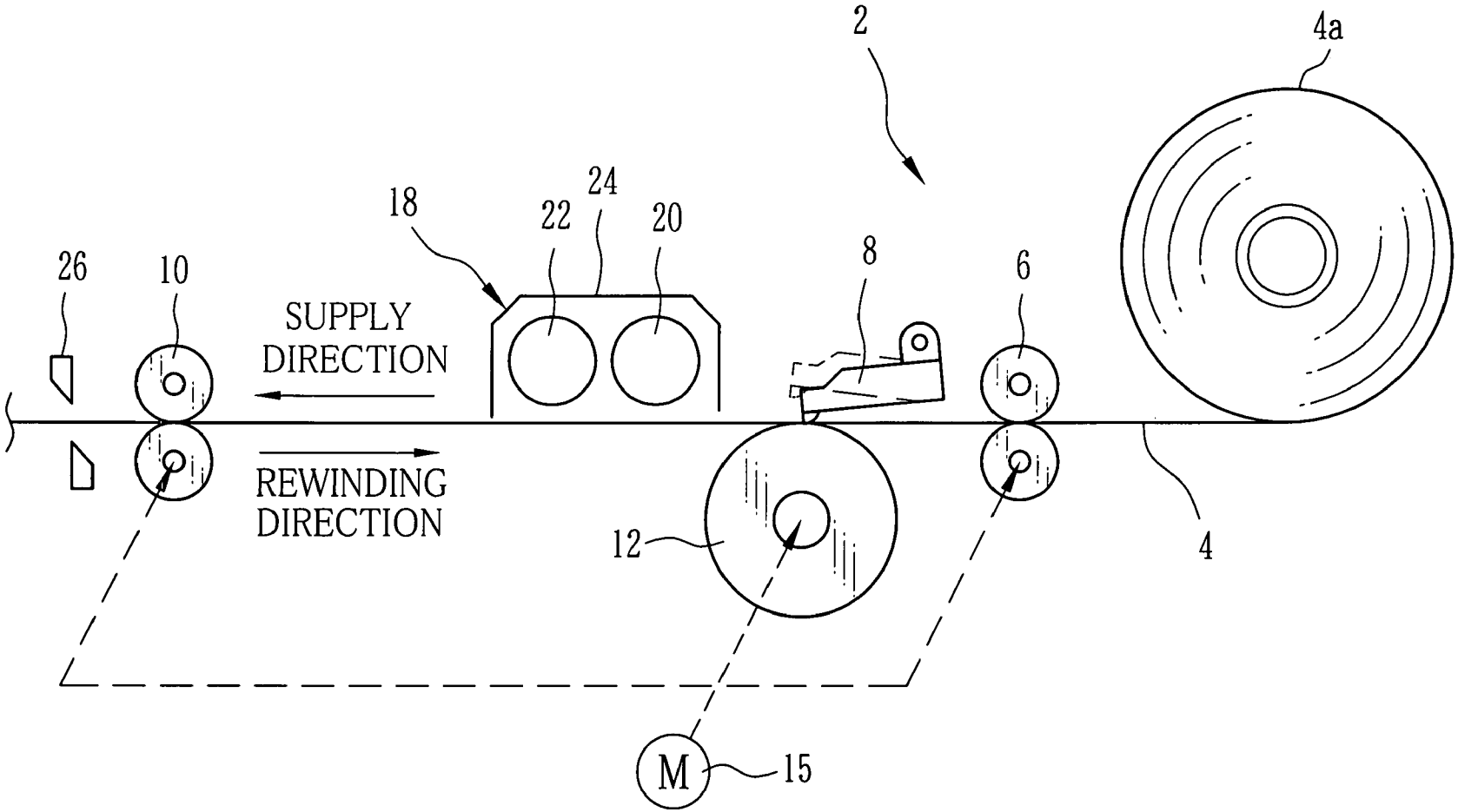
FIG. 1 is a schematic diagram illustrating a color thermal printer of the present invention.

FIG. 1 is a schematic diagram illustrating a color thermal printer of the present invention. A color thermal printer 2 is loaded with a roll 4*a* of long color thermal recording sheet 4 being wound as a recording medium. A sheet supply roller 6 transports recording sheet 4 to a thermal head 8 and returns to a roll 4. The sheet supply roller 6 and a discharge roller 10 apply back and front tension to recording sheet 4.

The thermal head 8 and a platen roller 12 which supports recording sheet 4 are provided on a transporting path of recording sheet 4, facing each other. The thermal head 8 includes a heating element array in which multiple heating elements are aligned perpendicular to a drawing along a main scan direction. Heat energy is generated by the multiple heating elements to heat recording sheet 4. The thermal head 8 moves between a recording position to press recording sheet 4 on the platen roller 12 and the separated position to be disposed apart from the platen roller 12. The platen roller 12 is rotated by a motor 15, to transport recording sheet 4 to supply and returning directions.

An optical fixing device 18 consists of an yellow fixing lamp 20, a magenta fixing lamp 22 and a reflector 24. When a yellow image is recorded on recording sheet 4, the yellow fixing lamp 20 turns on and irradiates fixing light, the peak value of which is 420 nm, to fix the yellow image on recording sheet 4. When a magenta image is recorded on recording sheet 4, the magenta fixing lamp 22 turns on and irradiates near ultraviolet rays, the peak value of which is 365 nm, to fix the magenta image on recording sheet 4.

Figure 2:
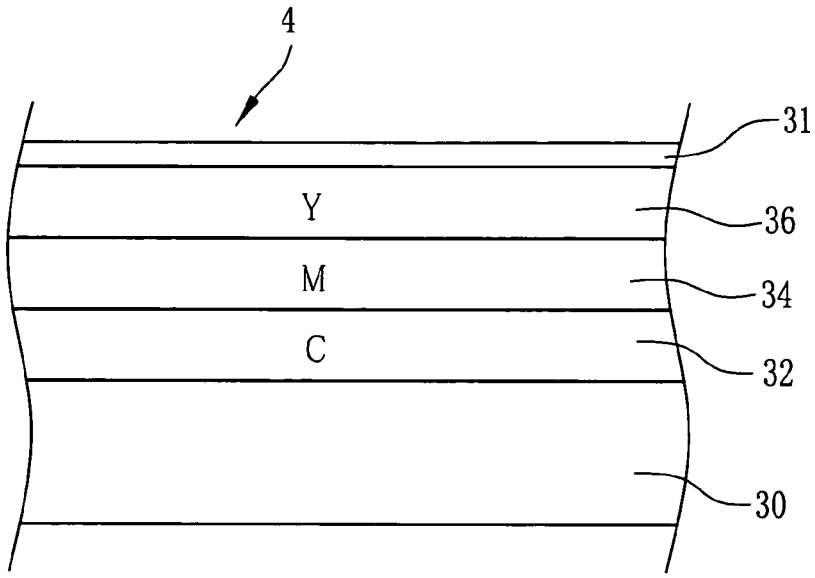
FIG. 2 is a cross sectional view illustrating a color thermal recording sheet.
Figure 3:
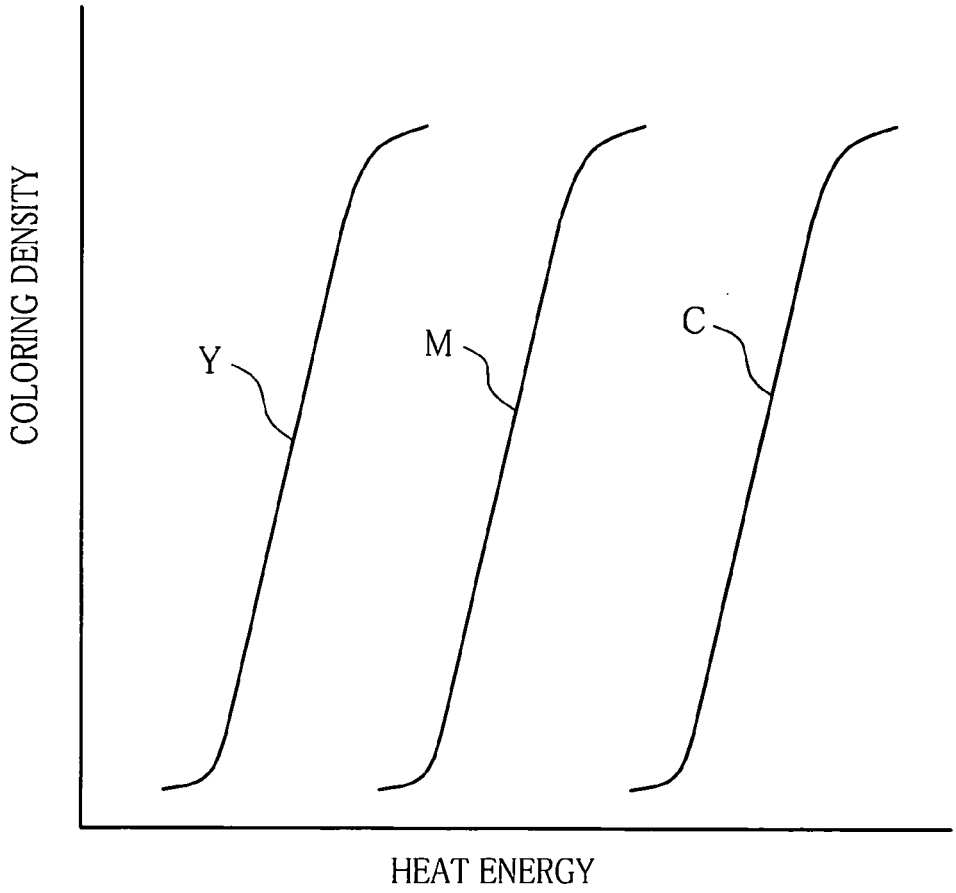
FIG. 3 is a graph illustrating coloring properties of each coloring layer against heat energy.

In FIG. 2, recording sheet 4 includes a cyan thermal coloring layer 32, a magenta thermal coloring layer 34, a yellow thermal coloring layer 36 and a protecting layer 31, overlaid on a support 30 in sequence on one another. The yellow thermal coloring layer 36 loses its coloring ability when fixing light is irradiated from the yellow fixing lamp 20. The magenta thermal coloring layer 34 loses its coloring ability when ultraviolet rays are irradiated from the magenta fixing lamp 22. In FIG. 3, the cyan thermal coloring layer 32 as a lowermost layer, which is lowest in heat sensitivity among three thermal coloring layers, is colored cyan with large heat energy. The yellow thermal coloring layer 36 as a topmost layer, which is highest in heat sensitivity among three thermal coloring layers, is colored yellow with small heat energy. Magenta thermal coloring layer 34 is colored with medium-heat energy between the yellow and cyan thermal coloring layers. Yellow, magenta and cyan images are recorded in sequence, to form a full color image on the recording sheet.

Recording sheet 4 in which thermal recording by the thermal head 8 and optical fixing by the optical fixing device 18 are executed, is cut into smaller sheets by a cutter 26 in a predetermined size, to be discharged outside the color thermal printer 2.

Figure 4:
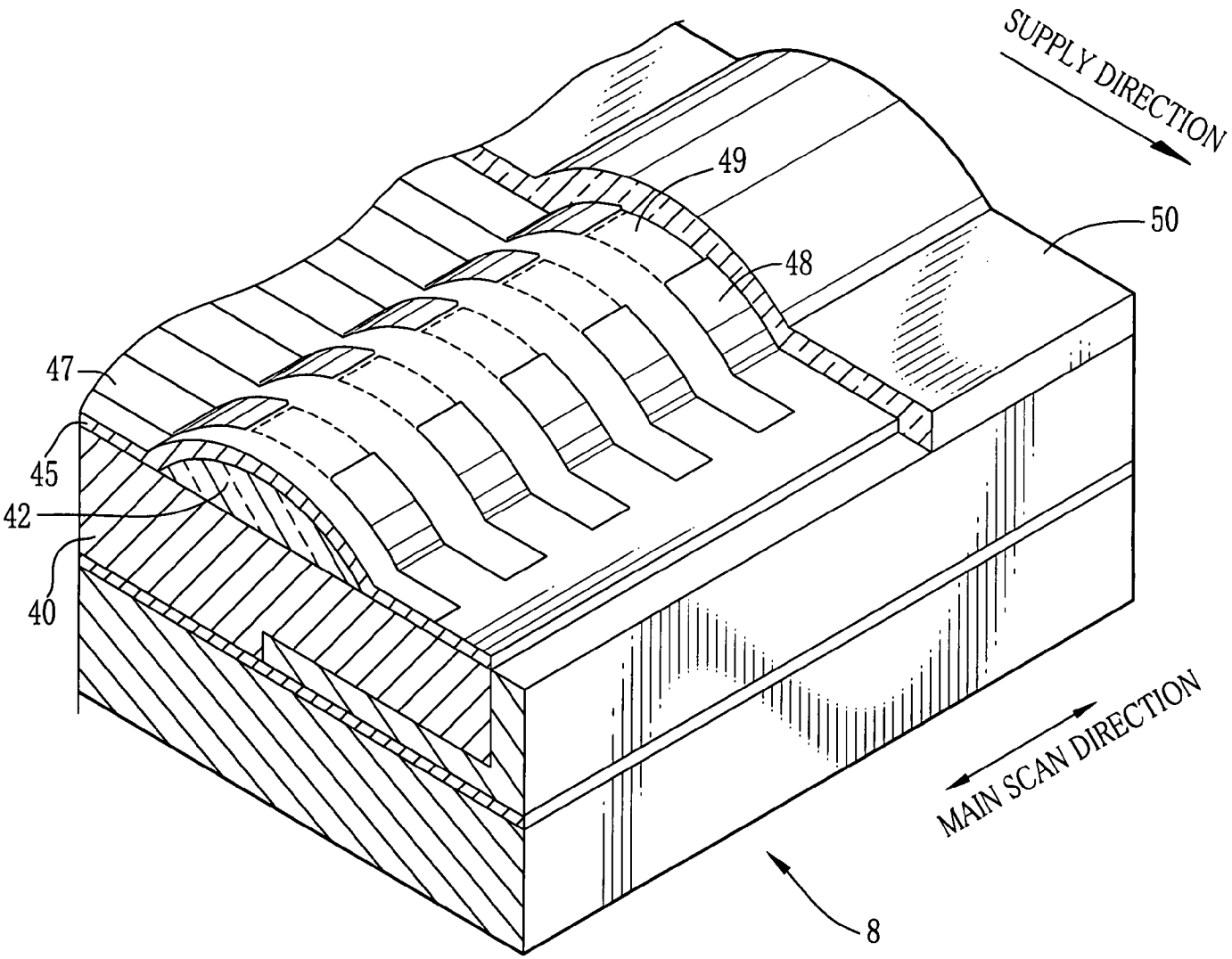
FIG. 4 is a perspective view illustrating a thermal head.
Figure 5:
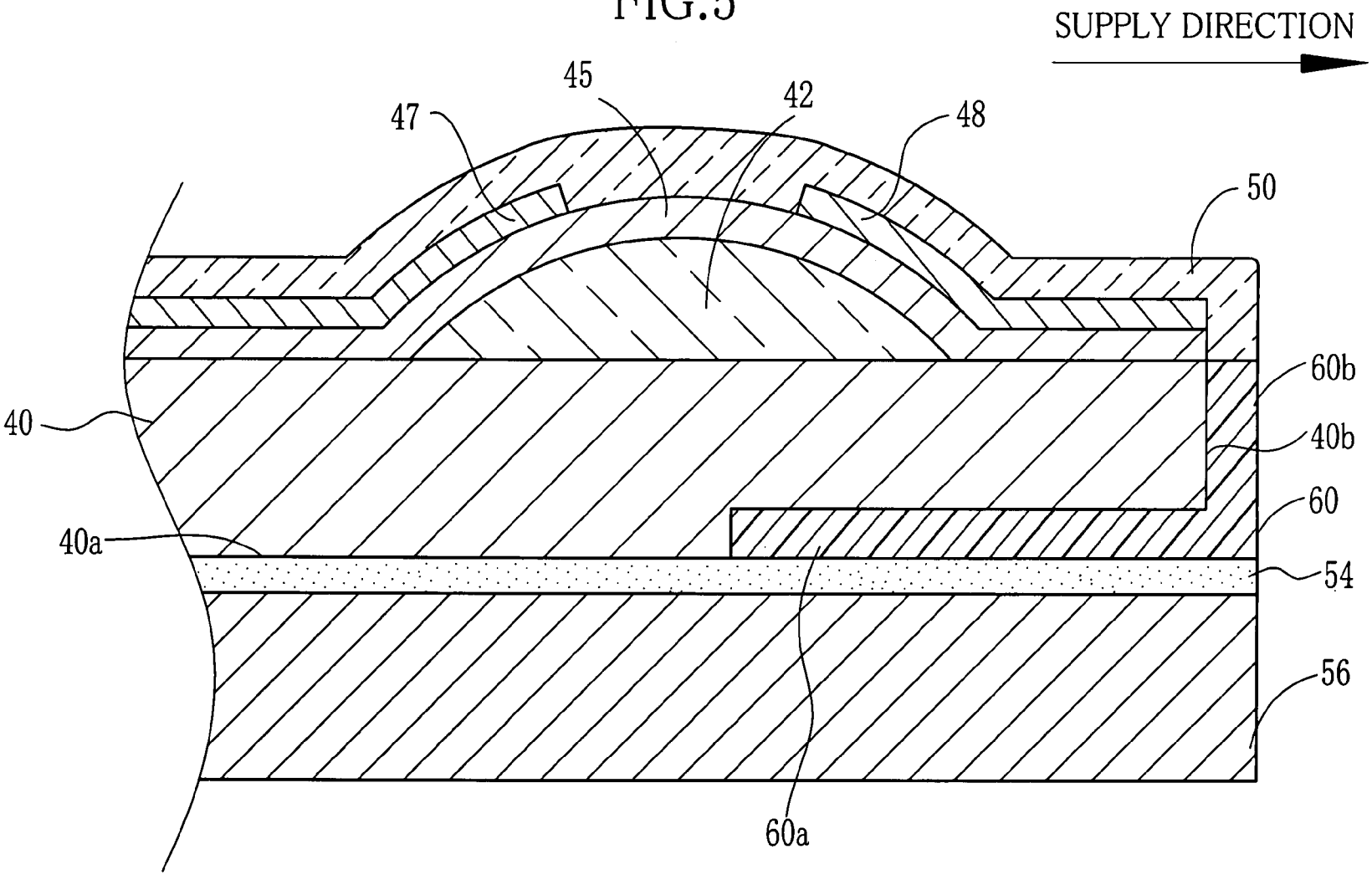
FIG. 5 is a partial perspective view illustrating a thermal head which includes a thermal insulator provided on an electrically insulating substrate downstream in a supply direction.

In FIGS. 4 and 5, the thermal head 8 includes a partial glaze 42 protruded from upper surface of an electrically insulating substrate 40 to extend in a main scan direction, on which heat-generating resistors 45 are overlaid. Individual (discrete) electrodes 47 are arranged on the heat-generating resistors 45 in a main scan direction upstream in a supply direction. According to the individual electrodes 47, common electrodes 48 are arranged in a main scan direction of the heat-generating resistors 45 downstream in a supply direction. A portion of the heat-generating resistors 45 which is an area sandwiched between individual electrodes 47 and common electrodes 48 becomes heating elements 49. A protecting layer 50 is consisted of silicon compound, overlaid on the heat-generating resistors 45, the individual electrodes 47 and the common electrodes 48.

Common electrodes 48 are connected each other, and current supplied thereto is controlled by a driving circuit (not shown) together with the individual electrodes 47. The individual electrodes 47 and common electrodes 48 are energized by driving signal output from the driving circuit via the heat-generating resistors 45, thereby heating elements 49 generate heat.

A heat dissipating plate 56 is adhered to a lower face 40*a* of the electrically insulating substrate 40 via an adhesive layer 54. An L-shape thermal insulator 60 is partially provided in a region between the insulating substrate 40 and the adhesive layer 54. The thermal insulator 60 consisting of insulating material such as polyimide, PET (polyethylene terephthalate), and other suitable resin, includes a horizontal section 60*a* and a vertical section 60*b*. The horizontal section 60*a* is positioned directly below common electrodes 48, covering a part of the lower face 40*a* of the insulating substrate. The vertical section 60*b* covers the distal end 40*b* of the insulating substrate downstream in a supply direction. Heat generated at heating elements 49 and conducted to the common electrodes 48 downstream in a supply direction is neither dissipated outside from the distal end of the common electrodes 48 of the insulating substrate 40 through the thermal insulator 60 nor conducted to the heat dissipating substrate 56. Therefore, while reduction in temperature in the common electrodes 48 side of the insulating substrate 40 can be suppressed, temperature in the common electrodes 48 side of the protecting layer 50 relatively increases, compared to the manner without the thermal insulator 60.

Next, the operation of the color thermal printer 2 will be explained. In FIG. 1, when starting print operation, the sheet supply roller 6 is driven to transport recording sheet 4. When the distal end of recording sheet 4 is detected by a photo interrupter (not shown), the thermal head 8 is moved to printing position and pressed on recording sheet 4. When the platen roller 12 is rotated by the motor 15, recording sheet 4 pinched by the thermal head 8 and the platen roller 12 is transferred in the supply direction for recording. Simultaneously, the thermal head 8 is driven to record yellow image in a recording area on a line-by-line basis. There is a case that steam or vapor is generated from recording sheet 4 since recording sheet 4 is heated. However, thermal dissipation at the side of the common electrodes 48 is suppressed by the thermal insulator 60, so that reduction in temperature on the protecting layer 50 at the side of the common electrodes 48 can be suppressed. Therefore, there occurs no condensation of steam or vapor on the protecting layer 50, so that there is no influence in printing due to water drop.

When passing through the yellow fixing lamp 20, the area where the yellow image is recorded is optically fixed by irradiation of ultraviolet rays. After completion of yellow image recording, the thermal head 8 is moved to the separated position. After completion of optical fixing of the yellow image, the yellow fixing lamp 20 turns off. Then, when recording sheet 4 is transported to the predetermined position in a rewinding direction, the thermal head 8 is moved to printing position. In synchronism with transportation of recording sheet 4 by the platen roller 12 in a supply direction for recording, the thermal head 8 is driven to record magenta image in a recording area on a line-by-line basis.

The magenta fixing lamp 22 turns on during recording of the magenta image, to optically fix the magenta image. After completion of magenta image recording, the thermal head 8 is moved to the separated position. After completion of optical fixing of the magenta image, the magenta fixing lamp 22 turns off. When recording sheet 4 is transported to the predetermined position in a rewinding direction, the thermal head 8 is moved to printing position to record the cyan image. Also in magenta and cyan image recording in a similar manner with yellow image recording, temperature on the common electrodes 48 side of the protecting layer 50 can be suppressed since the thermal insulator 60 prevents thermal dissipation from heating elements 49. Therefore, it is possible to prevent water drop from being stacked on the surface of the protecting layer 50. After completion of cyan image recording, printing portion of recording sheet 4 is transported by the discharge roller 10 and cut into a sheet by the cutter 26 at a boundary between printing portion and margin, to form a print.

Figure 6:
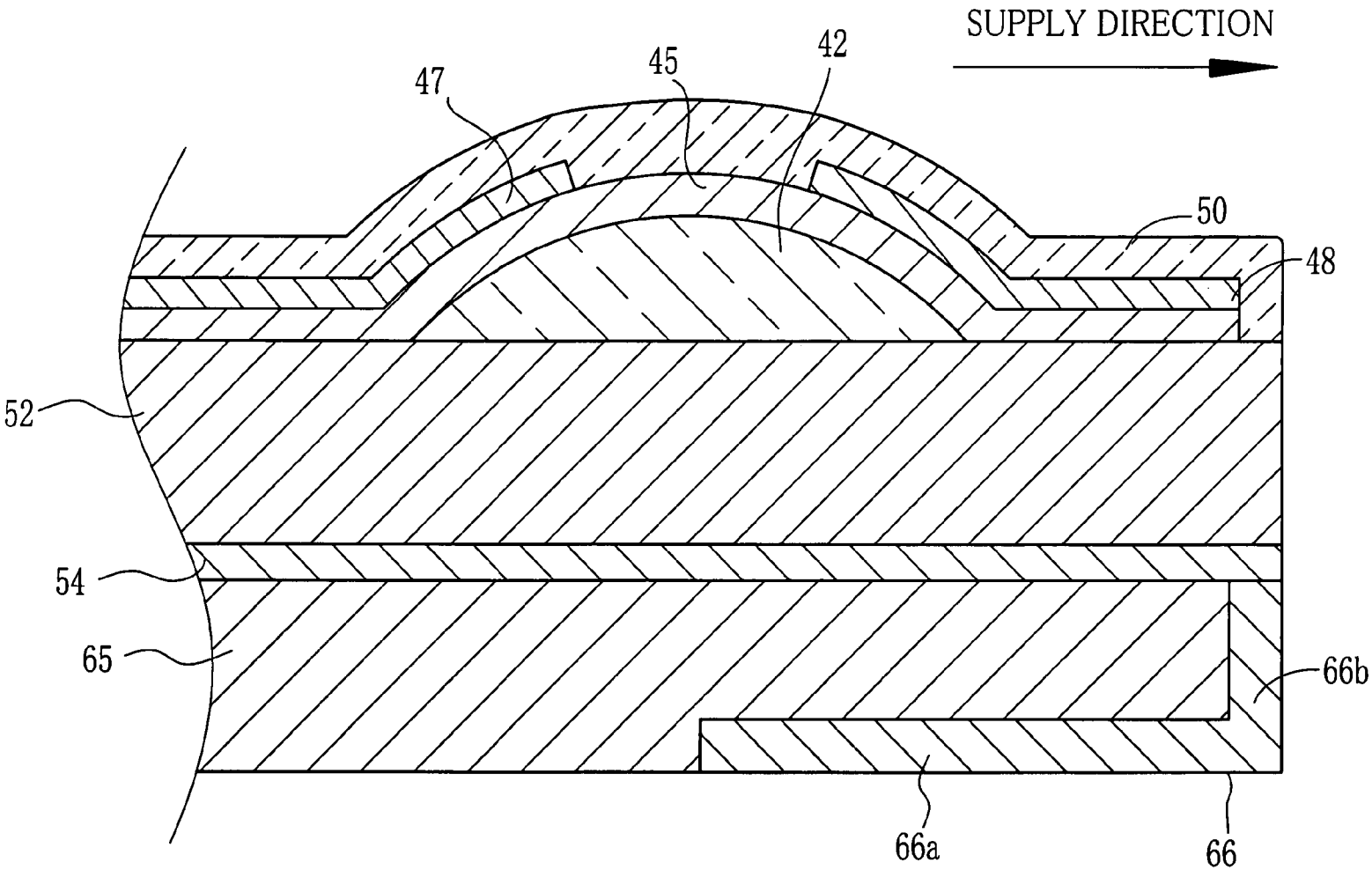
FIG. 6 is a partial perspective view illustrating a thermal head which includes a thermal insulator provided at on distal end of a heat dissipating substrate downstream in a supply direction.

However, the L-shape thermal insulator 60 is provided on the electrically insulating substrate 40 downstream in a supply direction, in the above embodiment. However, it may be provided on a heat dissipating plate 65 downstream in a supply direction shown in FIG. 6. In FIG. 6, the parts having the same structure and function as FIG. 5 have the same reference numerals, and their description will not be repeated. A thermal insulator 66 includes a horizontal section 66*a* and a vertical section 66*b*, formed in a shape of "L". The horizontal section 66*a* covers a part of lower face of the heat dissipating substrate 65 and the vertical section 66*b* covers a distal face of the heat dissipating substrate 65 downstream in a supply direction.

Figure 7:
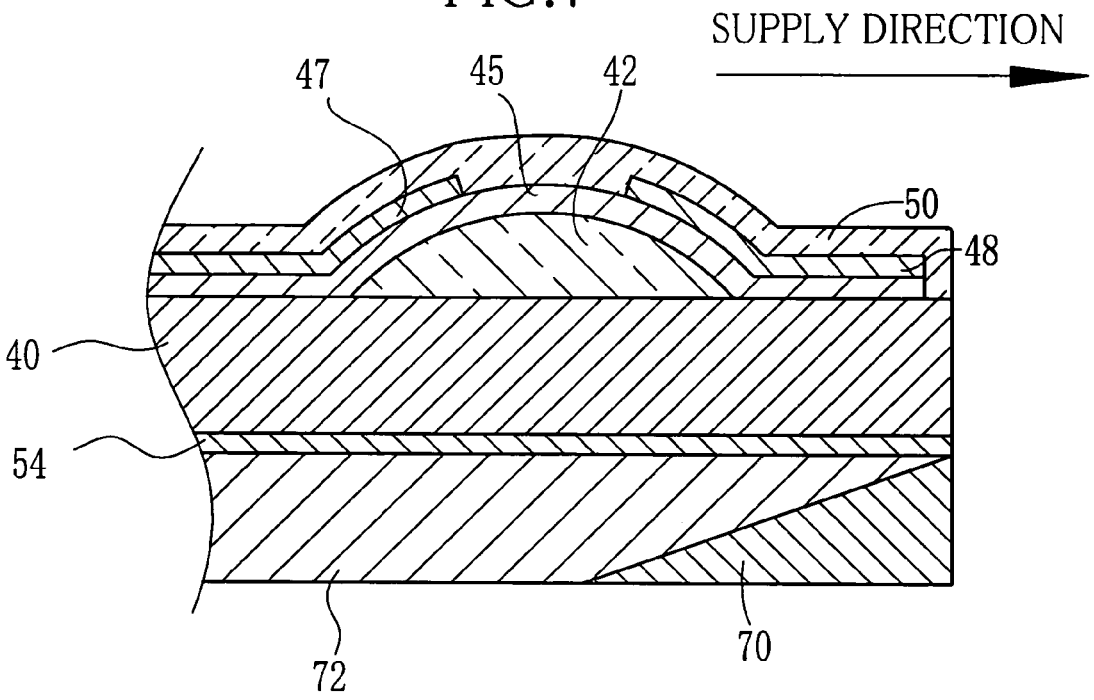
FIG. 7 is a partial perspective view illustrating a thermal head which includes a triangular thermal insulator provided on the heat dissipating substrate.
Figure 8:
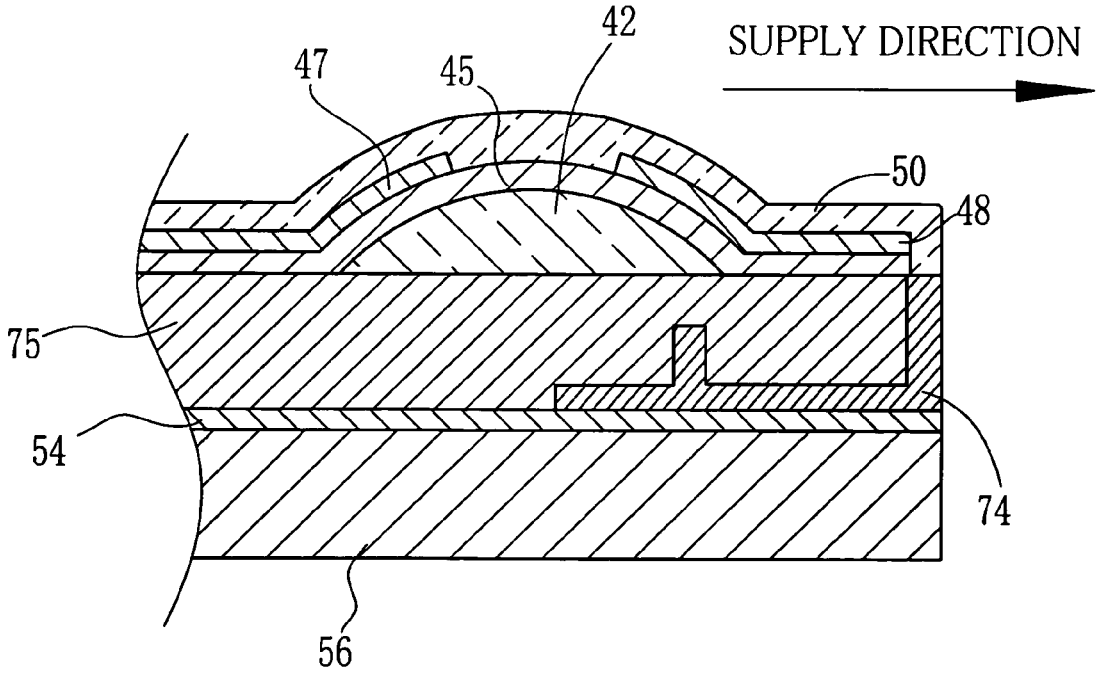
FIG. 8 is a partial perspective view illustrating a thermal head which includes a thermal insulator formed in the shape of "F" provided on the insulating substrate.
Figure 9:
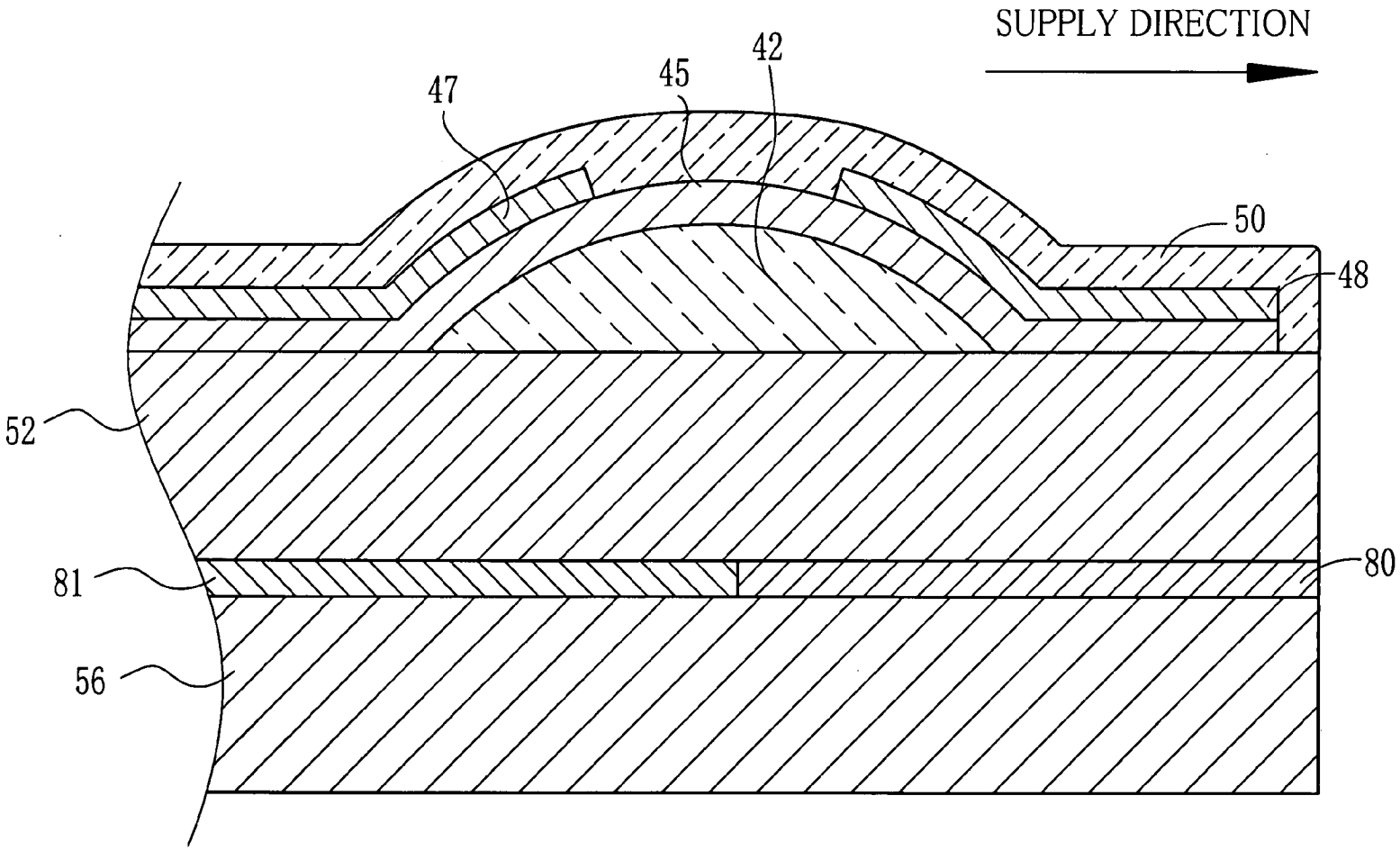
FIG. 9 is a partial perspective view illustrating a thermal head, in which a heat dissipating adhesive layer and an insulating adhesive layer are used for adhering the insulating substrate and the heat dissipating substrate.

Moreover, the L-shape thermal insulator 66 is used in the above embodiment. However, it may be possible to use a thermal insulator formed in a shape other than "L". For example, a thermal insulator 70 formed in a shape of triangle may be provided at the distal end of a heat dissipating plate 72 downstream in a supply direction shown in FIG. 7. Further, a thermal insulator 74 formed in a shape of "F" may be provided at the distal end of an insulating substrate 75 downstream in a supply direction shown in FIG. 8.

A thermally insulating adhesive layer 80 may be used for adhering an electrically insulating substrate 52 and the heat dissipating plate 56 downstream in a supply direction. A heat dissipating adhesive layer 81 is used for adhering other areas except for stated above. For example, siliceous adhesive is used as insulating adhesive and silicone adhesive is used as heat dissipating adhesive. Due to the insulating adhesive layer 80, heat generated at heating elements 49 is prevented from conduction to the heat dissipating substrate 56 from the insulating substrate 40 downstream in a supply direction, and thermal dissipation from the distal end of the insulating adhesive layer 80 downstream in a supply direction is prevented. Therefore, reduction in temperature on the protecting layer 50 downstream in a supply direction can be suppressed.

Furthermore, the electrically insulating substrate and the heat dissipating substrate may be adhered by using insulating adhesive and heat dissipating adhesive and the thermally insulating material may be provided to at lease one of the insulating substrate and the heat dissipating substrate.

The present invention is applicable not only to a color thermal printer in the above embodiment. Moreover, the present invention can be applicable to a thermal printer for printing a black-and-white image.

In the above embodiment, the thermal head operates for thermal recording while the thermal recording sheet is moved in the supply direction of supply from the recording sheet roll. However, a printer of the invention can be a type in which the thermal recording sheet is moved in a first direction from the recording sheet roll, and thereafter the thermal head operates for the thermal recording while the thermal recording sheet is moved in a second direction reverse to the first direction. In this structure, the second direction is the supply direction or feeding direction. In the present specification, the term of supply direction is used chiefly with relevancy to the thermal head in the thermal recoding operation.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal head for executing thermal recording of an image, in which a plurality of heating elements formed on a substrate is pressed on a thermal recording material which is transported in a supply direction, to be driven, said thermal head comprising:

a thermal insulator provided only downstream of said heating elements in said supply direction, for preventing heat generated at said heating elements from being dissipated externally.

2. A thermal head as claimed in claim 1, further comprising:

a partial glaze layer formed on said substrate;

a heat-generating resistor layer formed on said partial glaze layer; and individual and common electrodes arranged on said heat-generating resistor layer along said supply direction, wherein said heating elements are constituted of a region between said individual and common electrodes, said thermal insulator being disposed on said substrate in the side opposite to said partial glaze layer.

3. A thermal head as claimed in claim 2, wherein said thermal insulator covers an end face of said substrate downstream in said supply direction.

4. A thermal head as claimed in claim 1, further comprising:

a heat dissipating material disposed on said substrate in the side opposite to said heating elements, said thermal insulator being disposed on said heat dissipating material.

5. A thermal head as claimed in claim 4, wherein said thermal insulator covers an end face of said substrate downstream in said supply direction.

6. A thermal head as claimed in claim 1, further comprising:

adhesive layers provided on said substrate in the side opposite to said heating elements, including a thermally insulating adhesive layer which is provided downstream of said heating elements in said supply direction and constitutes said thermal insulator, and a heat dissipating adhesive layer disposed adjacent to said thermally insulating adhesive layer; and a heat dissipating material attached to said substrate through said adhesive layers.

7. A thermal head for executing thermal recording of an image, in which a plurality of heating elements formed on a substrate is pressed on a thermal recording material which is transported in a supply direction, to be driven, said thermal head comprising:

a heat dissipating material disposed on said substrate in the side opposite to said heating elements; and a thermal insulator disposed on at least one of said substrate and said heat dissipating material, for preventing heat generated at said heating elements from being dissipated externally, said thermal insulator being provided only downstream of said heating elements in said supply direction.

8. A thermal head as claimed in claim 7, further comprising:

a partial glaze layer formed on said substrate;

a heat-generating resistor layer formed on said partial glaze layer; and individual and common electrodes arranged on said heat-generating resistor layer along said supply direction, wherein said heating elements are constituted of a region between said individual and common electrodes, said thermal insulator being disposed on said substrate in the side opposite to said partial glaze layer.

9. A thermal head as claimed in claim 8, wherein said thermal insulator covers an end face of said substrate downstream in said supply direction.

10. A thermal head as claimed in claim 7, wherein said thermal insulator is disposed on said heat dissipating material.

11. A thermal head as claimed in claim 10, wherein said thermal insulator covers an end face of said substrate downstream in said supply direction.

12. A thermal head as claimed in claim 7, further comprising:

adhesive layers provided between said substrate and said heat dissipating material, including a thermally insulating adhesive layer provided downstream of said heating elements in said supply direction and a heat dissipating adhesive layer disposed adjacent to said thermal insulating adhesive layer.

* * * * *